US007114432B1

(12) United States Patent
Boone et al.

(10) Patent No.: US 7,114,432 B1
(45) Date of Patent: Oct. 3, 2006

(54) TORQUE LIMITING DEVICE FOR HYDRAULIC PISTON PUMP

(75) Inventors: Nick L Boone, Ames, IA (US); Gary R Lingenfelter, Nevada, IA (US)

(73) Assignee: Sauer-Danfoss Inc., Ames, IA (US)

( * ) Notice: Subject to any disclaimer, the term of this patent is extended or adjusted under 35 U.S.C. 154(b) by 57 days.

(21) Appl. No.: 11/053,804

(22) Filed: Feb. 9, 2005

(51) Int. Cl.
*F01B 3/02* (2006.01)
*F01B 31/04* (2006.01)

(52) U.S. Cl. ..... 91/505; 92/12.2; 92/131; 417/222.1

(58) Field of Classification Search ..... 91/505, 91/506; 92/12.2, 13, 57, 71, 131; 60/445, 60/452; 417/222.1, 267, 213
See application file for complete search history.

(56) References Cited

U.S. PATENT DOCUMENTS 3,070,031 A * 12/1962 Puryear ..... 417/222.1
3,667,867 A * 6/1972 Boydell et al. ..... 91/506
3,768,928 A * 10/1973 Miller et al. ..... 60/451
3,834,280 A * 9/1974 Jones ..... 91/505
3,834,836 A 9/1974 Hein et al.
3,864,063 A * 2/1975 Martin ..... 417/222.1
4,723,892 A * 2/1988 Cowan ..... 92/131
5,073,091 A 12/1991 Burgess et al.
5,782,160 A 7/1998 Boone
5,794,515 A 8/1998 Bethke
6,209,825 B1 4/2001 Scott
6,354,812 B1 3/2002 Todd

* cited by examiner

*Primary Examiner*—Igor Kershteyn

(57) ABSTRACT

A torque control for a hydrostatic piston pump that provides for a servo piston rod that is connected to the swashplate of the pump and connected to a servo piston within a first cavity that receives compensation pressure that urges the servo piston toward the swashplate. The servo piston has a stem that extends into a bore and is in contact with the stem of a maximum displacement piston that extends into a second cavity that is acted upon by system pressure to urge the maximum displacement piston toward the swashplate. Additionally, within the second cavity is a set of Bellville washers that surround the stem of the maximum displacement piston to limit the movement of the maximum displacement piston toward the swashplate.

6 Claims, 2 Drawing Sheets

TORQUE LIMITING DEVICE FOR HYDRAULIC PISTON PUMP

BACKGROUND OF THE INVENTION

This invention relates to an improved hydraulic pump that is able to limit the amount of torque produced within the pump. More specifically and without limitation, this invention relates to a torque limiting system within a hydraulic piston pump.

The pressure compensated hydraulic piston pump is widely used in industry as a means of driving a wide range of hydraulic devices. The pressure compensated pump delivers a fixed maximum volume of fluid at pressures below the design level and then an abrupt cutoff of the flow as the design pressure level is reached. Such pumps are usually equipped with a variable pressure control which allows the cutoff pressure to be easily adjusted. The operation of the pump can be ascribed as follows: the pump is driven by an external power source through a shaft. A cylinder block is connected to and rotates with the shaft. A series of pistons in the cylinder block rotate with the block and rests against the side of a tilted swashplate which is located within the pump housing.

As the cylinder block rotates the pistons move back and forth in the block with their displacement controlled by the angled swashplate to the axis of the driveshaft. Valve orifices allow entry of fluid into the pump on the backstroke of the pistons and out of the pump on the forward stroke of the pistons. The inlet and outlet to the pump are located in an end cap. At a fixed rotational speed and fixed swashplate angle the pump will deliver a constant flow of fluid at varying pressures. A pressure compensating valve senses the hydraulic system pressure and as the pressure approaches the maximum operating pressure selected, opens a pressure compensating conduit to allow a flow of fluid under pressure. The pressure from the conduit then causes movement of a piston, thus causing movement of the swashplate.

Despite these advances in the art, a problem occurs when there is a need for a torque limitation upon the shaft used to drive the piston pump. Traditional torque control requires a displacement feedback in order to regulate pressure to achieve a constant torque curve. Hence, when the need of the hydraulic piston pump is only to clip the maximum input torque this displacement feedback is not required. Thus, there is a need in the art to provide for a torque control that is able to clip the maximum input torque without displacement feedback.

Attempts in the art have been made to solve this problem. For instance, in Cowan (U.S. Pat. No. 4,723,892), a helical spring is used in combination with altering the compensation and system pressures in order to control the piston pump. This system has many disadvantages including the use of a helical spring (which may be very large to achieve the desired effect) that requires additional mechanical parts and also results in compensator pressure working against the system pressure causing inefficiencies. Thus, there is a need in the art to provide a torque control that is able to limit the torque on a shaft that overcomes the stated problems.

Therefore, it is a principal object of the present invention to provide a torque control for a hydrostatic piston pump that will clip the maximum input torque of the piston pump without displacement feedback that improves upon the state of the art.

Yet another object of the present invention is to provide a torque control for a hydrostatic piston pump that does not use a helical spring element to control the maximum torque output of the hydrostatic cylinder piston pump.

Another object of the present invention is to provide a torque control for a hydrostatic piston pump that allows for compensator pressure and system pressure to act in the same direction to facilitate the control of the torque limiting control for a hydrostatic piston pump.

These and other objects, features, or advantages of the present invention will become apparent from the specification and claims.

BRIEF SUMMARY OF THE INVENTION

A torque control for a hydrostatic piston pump having a cylinder block and a swashplate disposed within a housing. The control comprises a servo piston rod that is connected to a servo piston that is within a first cavity that receives compensation pressure. The compensation pressure comes from a compensator pressure conduit that pumps pressure into the first cavity to urge the servo piston toward the swashplate. The servo piston is designed to have a head on its first end and a stem that is sealingly inserted within a bore. Contacting the stem of the servo piston within the bore is the stem of a maximum displacement piston that has a head within a second cavity. Within the second cavity is a system pressure conduit which supplies system pressure to the maximum displacement piston to urge it towards the swashplate. The maximum displacement of the maximum displacement piston towards the swashplate is controlled by a spring stopping element within the second cavity that limits the amount of travel the maximum displacement piston can move toward the swashplate, thus limiting the displacement reduction. As system pressure builds, the maximum displacement piston begins to compress the Bellville washer set until it reaches solid length. This results in a reduced displacement at high pressure, thus limiting the torque required by the pump.

DESCRIPTION OF THE PREFERRED EMBODIMENTS OF THE INVENTION

Figure 1:
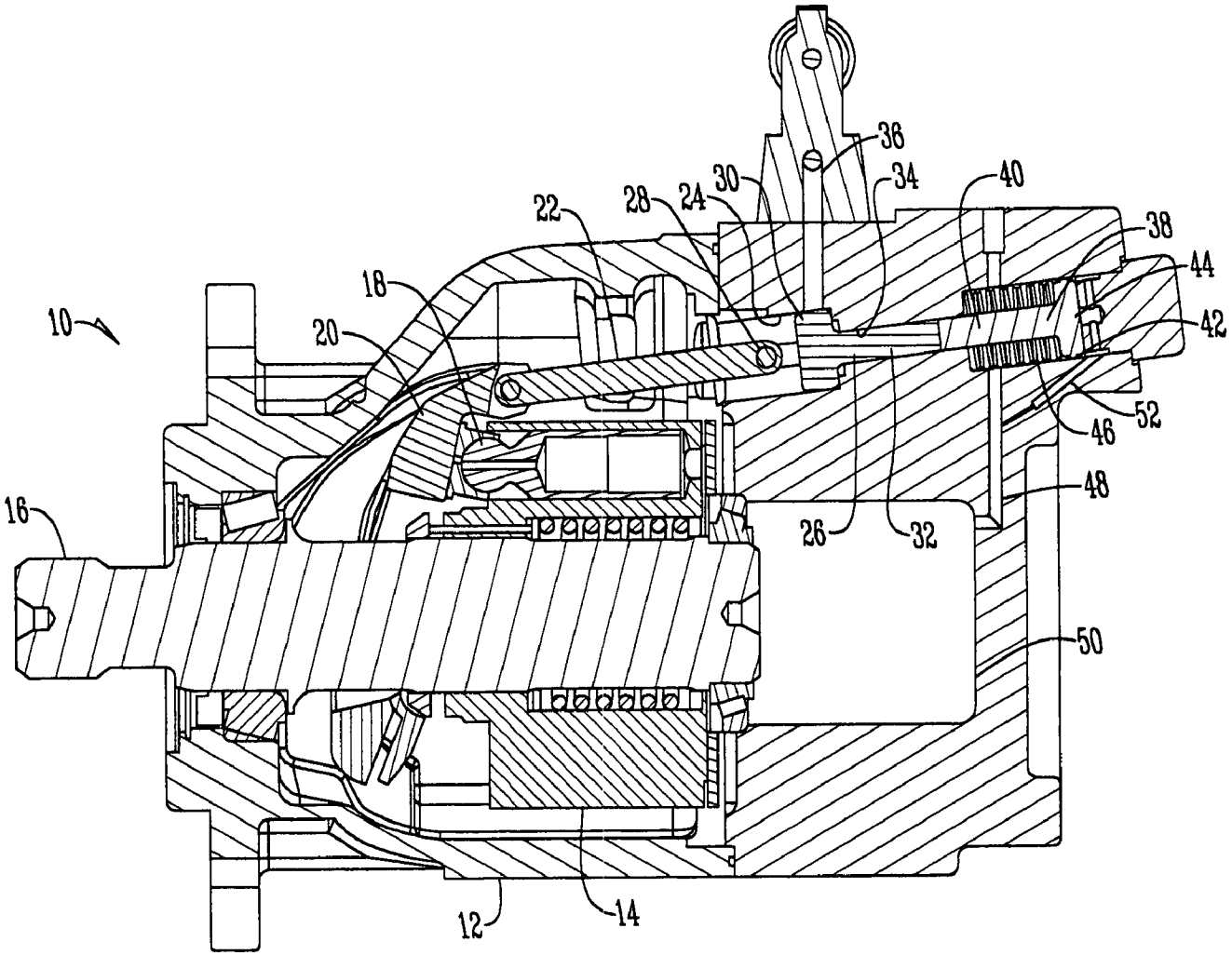
FIG. 1 is a cross sectional view of a torque control within a hydraulic piston pump that uses a pin joint connection between the servo piston rod and the servo piston.
Figure 2:
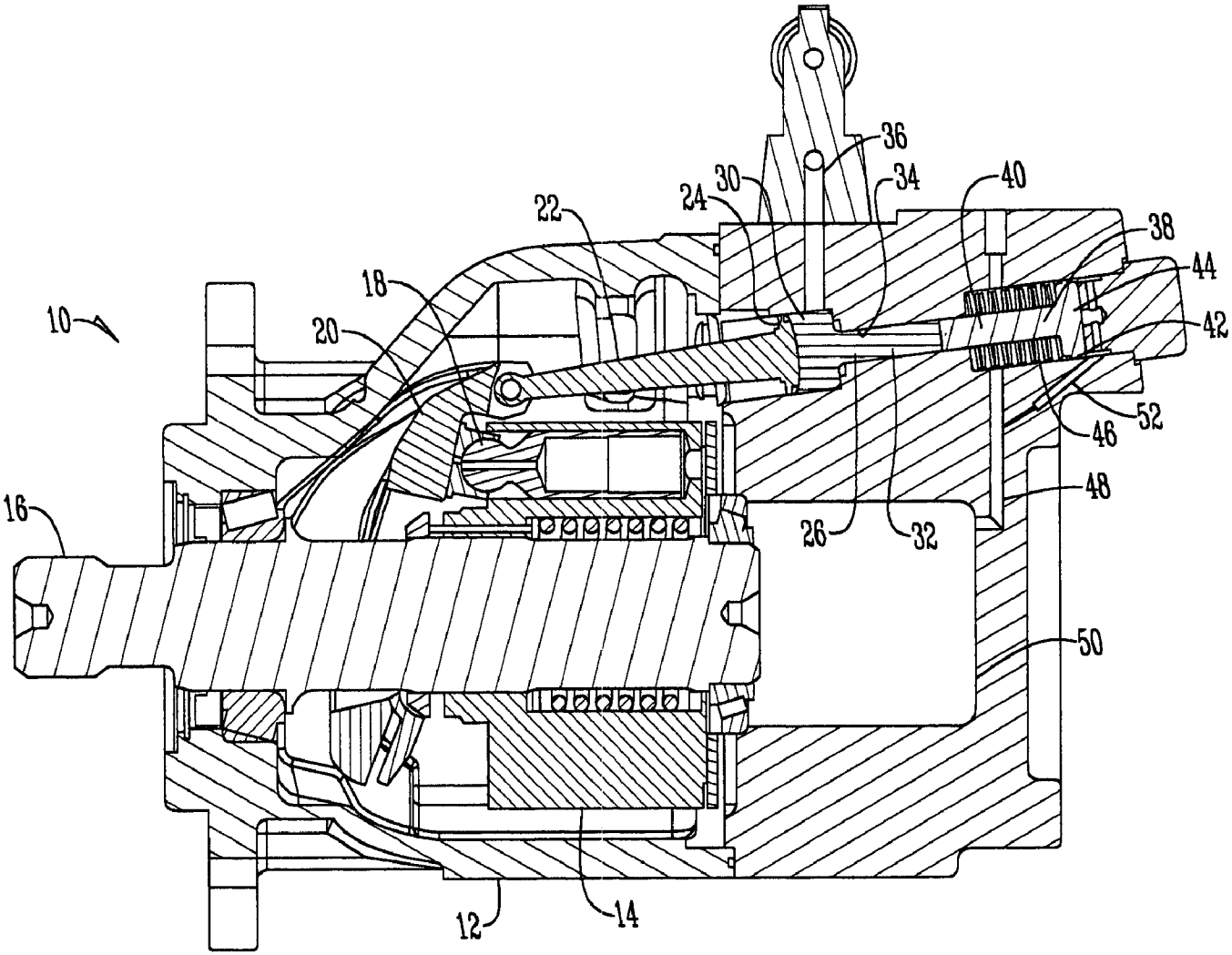
FIG. 2 is a sectional view of a torque control within a hydraulic piston pump that has a connection between the servo piston rod and the servo piston that is a sliding/butt joint.

FIGS. 1–2 show a hydrostatic piston pump 10. The hydrostatic piston pump 10 has a housing 12 that contains a cylinder block 14 that is connected and rotates with shaft 16. A series of pistons 18 in the cylinder block 14 rests against a swashplate 20 that controls the operation of the piston pump.

The torque control of the hydrostatic piston pump 10 comprises a servo piston rod 22 that is operably connected to the swashplate 20 and is disposed within a first cavity 24. Connected within the first cavity 24 to the servo piston rod is a servo piston 26. One skilled in the art will appreciate that the servo piston rod 24 and servo piston 26 may be connected by a pin joint connection 28, or as an alternative, as seen in FIG. 2 by a sliding/butt joint. The servo piston 26 has a head 30 disposed within the first cavity 24 and a stem 32 that is disposed within a bore 34. The stem 32 is of size and shape to completely seal the bore 34 to ensure that no pressure from the cavity 24 is communicated within the bore 34. Cavity 24 additionally receives compensation pressure from a compensation pressure conduit 36 that supplies pressure into cavity 24 and against the head 30 of the servo piston 26 urging it toward the swashplate 20.

Contacting the servo piston 26 within the bore 30 is a maximum displacement piston 38. The maximum displacement piston 38, like the servo piston 26, has a stem portion 40 that is within the bore 34 and extends out of the bore into a second cavity 42 and extends into a head 44 that is disposed within the second cavity 42. Additionally, within the second cavity 42 is a stack of Bellville washers 46 that surround the stem 40 of the maximum displacement piston 38 and act as a spring stopping element to limit movement of the maximum displacement piston 38 toward the swashplate 20. As a spring, the Bellville washers 46 regulate the amount of movement versus the magnitude of system pressure applied against the head 44 of the maximum displacement piston. One skilled in the art will appreciate that the stopping function of the Bellville washers could be replaced by any stopping element such as an annular shoulder. The second cavity 42 additionally communicates with a case drain conduit 48 that drains fluid from the second cavity 42 to a tank 50. Also, a system pressure conduit 52 supplies system pressure to the head 44 of the maximum displacement piston 38 urging the maximum displacement piston toward the swashplate 20.

In operation, to control the torque of the hydraulic piston pump, the system pressure conduit 52 supplies the second cavity 42 with system pressure to urge the maximum displacement piston 38 towards the swashplate. Thus, the servo piston and maximum displacement piston act in unison to control the tilt of the swashplate 20. Bellville washers 46 act as a stopping element and against the system pressure to stop the maximum displacement piston from forcing too great of tilt of the swashplate 20. Meanwhile the case drain conduit drains excess fluid within the second cavity 42.

Thus, one skilled in the art will appreciate that by having the servo piston 26 juxtapositioned coaxially in a common bore 30 with the maximum displacement piston 38 within the pump housing that the communication of the compensation pressure on the maximum displacement piston, in opposition to the system pressure, is eliminated. Additionally, one skilled in the art will appreciate that this system eliminates the need for a helical spring and at the same time provides for an effective method of clipping the maximum input torque of the hydrostatic cylinder pump without the use of displacement feedback. Therefore, each and every stated objective has been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A torque control for a hydraulic piston pump having a cylinder block with a swashplate disposed within a housing comprising:

a servo piston rod operably connected to the swashplate;

a servo piston connected to the servo piston rod and disposed within a first cavity and extending sealingly into a bore;

a compensator pressure conduit supplied to the first cavity to communicate pressure to the servo piston to urge the servo piston toward the swashplate;

a maximum displacement piston abutting the servo piston within the bore and extending into a second cavity;

a stopping element within the second cavity that impedes the maximum displacement piston movement towards the swashplate; and a system pressure conduit supplied to the second cavity to communicate pressure to the maximum displacement piston to urge the maximum displacement piston toward the swashplate.

2. The hydraulic piston pump of claim 1 further comprising a case drain conduit in communication with the second cavity.

3. The hydraulic piston pump of claim 1 wherein the stopping element is at least one Belleville washer.

4. The hydraulic piston pump of claim 1 wherein the stopping element is an annular shoulder.

5. The hydraulic piston pump of claim 1 wherein the servo piston is connected to the servo piston rod with a pin joint connection.

6. The hydraulic piston pump of claim 1 wherein the servo piston rod and the servo piston are connected with a butt joint.

* * * * *